US005898257A

United States Patent [19]

Sequerra et al.

[11] Patent Number: 5,898,257

[45] Date of Patent: Apr. 27, 1999

[54] COMBUSTION INITIATORS EMPLOYING REDUCED WORK FUNCTION STAINLESS STEEL ELECTRODES

[76] Inventors: Richard Isaac Sequerra, 157 Mountain Wood Rd., Stamford, Conn. 06903; Michael Albert DeLuca, 1534 Claas Ave., Holbrook, N.Y. 11741

[21] Appl. No.: 08/519,683

[22] Filed: Aug. 25, 1995

[51] Int. Cl.[6] ..... H01T 13/20; F02M 57/06; F02P 13/00; H01F 13/00

[52] U.S. Cl. ..... 313/141; 313/118; 123/169 EL

[58] Field of Search ..... 313/141, 142, 313/118, 143; 445/7, 46; 123/169 EL

[56] References Cited

U.S. PATENT DOCUMENTS 4,427,915 1/1984 Nishio et al. ..... 313/141
4,742,265 5/1988 Giachino et al. ..... 313/141
4,881,913 11/1989 Mann .
5,395,273 3/1995 Matsutani ..... 445/7
5,461,275 10/1995 Oshima ..... 313/141

*Primary Examiner*—Frank G. Font
*Assistant Examiner*—Mark Haynes
*Attorney, Agent, or Firm*—F. Eugene Davis, IV

[57] ABSTRACT

The electron emitting cathode of an initiator (spark plug or ignitor) comprises a small button of high temperature, preferably austenitic, stainless steel powder welded to a support conductor. The stainless steel powder has distributed through it a dopant powder consisting of a minor portion of a highly stable oxide of an element having a low work function. The dopant powder has a much smaller mesh size than the stainless steel powder (⅕or less). Rare earth lanthanides are preferred that have a low work function, preferably under 3.0 eV and are not radioactive. Cerium, in the form of $CeO_2$ is most preferred. The compositions of the low work function stainless steel electrodes and methods of making the same are disclosed.

22 Claims, 2 Drawing Sheets

COMBUSTION INITIATORS EMPLOYING REDUCED WORK FUNCTION STAINLESS STEEL ELECTRODES

TECHNICAL FIELD

This invention relates to Combustion Initiators Employing Reduced Work Function Stainless Steel Electrodes . More particularly, it relates to electron emitting cathodes comprising a small button of sintered high temperature stainless steel powder and a much smaller mesh size powder of a highly stable metal oxide having a work function under 3.0 eV. Rare earth metal oxides are preferred. Compositions and methods of manufacture are also disclosed.

BACKGROUND ART

Combustion initiators for internal combustion engines have traditionally employed electrode materials that require very small gaps between their electrodes—on the order of 1 mm for use with conventional automobile ignition systems. Traditional materials for these electrodes, for example nickel-chromium (Inconel) wear out after about 30,000 Km in ordinary automobiles. Platinum electrodes last longer, but are very expensive.

The spark in prior art plugs is so short in length that it often doesn't ignite all of the fuel air mixture and sometimes completely fails to ignite the fuel. Furthermore, the spark has a slow rise time so that it is not as "hot" as it could be if its rise time were shorter.

As a result, each cylinder in an internal combustion engine in automobiles, for example, experience misfires about 2% of the time. This leads to high emissions of unburned hydrocarbons and carbon monoxide pollutants and high fuel consumption.

DISCLOSURE OF THE INVENTION

We have discovered that if the cathode of a conventional initiator formed of stainless steel is doped with a low work function (3.0 eV or less) material the above problems are overcome. Preferably, the invention takes the form of a small button of sintered high temperature stainless steel powder doped with a rare earth metal oxide powder having a much smaller mesh size. The spark gap may be widened (the spark lengthened) to many millimeters. The high electron emissivity (low work function) cathode provides a shorter rise time and thus a "hotter" spark. Misfiring is reduced and the sintered surface wears better than Inconel.

Alternatively, the low work function oxide may be added to molten stainless steel and cast or otherwise formed into electrodes or buttons.

We have tested spark plugs according to our invention in a 1995 MAZDA® Protege® according to EPA protocols and found a 19% reduction in hydrocarbons, an 18% reduction in carbon monoxide emissions, and a 5% decrease in City fuel usage.

OBJECTS OF THE INVENTION

It is therefore an object of the invention to provide improved combustion initiators for internal combustion engines.

Another object of the invention is to provide such initiators providing elongated spark gaps and fast spark rise times.

A further object of the invention is to provide such initiators having relatively long lifetimes.

Yet another object of the invention is to provide compositions and methods of manufacturing cathodes for such initiators.

A yet further object of the invention is to provide such compositions and methods that are inexpensive.

Yet still another object of the invention is to decrease emissions and fuel use in internal combustion engines.

Other objects of the invention will in part be obvious and will in part appear hereinafter.

The invention accordingly comprises articles of manufacture, compositions, and methods of making the articles and compositions; the articles possessing the features, properties, and the relation of elements; the methods comprising several steps and the relation of one or more of such steps with respect to each of the other; and the compositions possessing the features, properties, and the relation of constituents, which are exemplified in the following detail disclosure. The scope of the invention is indicated in the claims.

BRIEF DESCRIPTION OF THE DRAWINGS

For a fuller understanding of the nature and objects of the invention, reference should be had to the following detailed description taken in connection with the following drawings, in which.

The same reference characters refer to the same elements throughout the several views of the drawings.

BEST MODE FOR CARRYING OUT THE INVENTION

Figure 1:
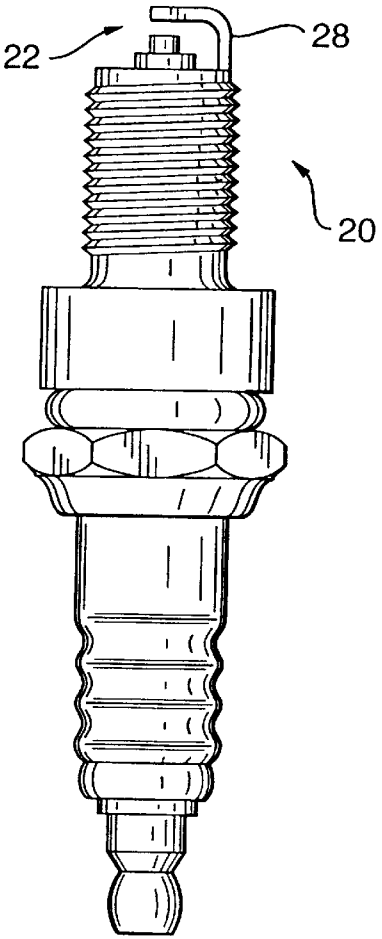
FIG. 1 PRIOR ART
FIG. 1 is a side view of a conventional spark plug.

Referring to FIG. 1, a conventional spark plug for an automobile internal combustion engine is generally indicated at 20. It provides a spark gap 22 of approximately one millimeter or less when used with conventional ignition systems.

Figure 2:
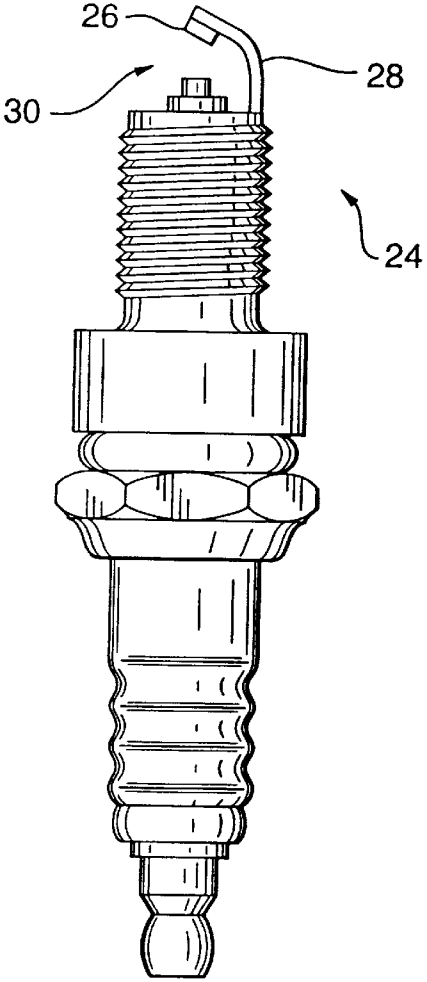
FIG. 2 is a side view of the spark plug of FIG. 1, after modification according to our invention.

FIG. 2 shows the same type of spark plug 24 modified according to the invention by incorporating a button 26 of sintered stainless steel powder incorporating a finer powdered low work function rare earth metal oxide. The button 26 is spot welded to the cathode (negative ground) lead 28 of the spark plug 24 and the spark gap 30 is greatly lengthened.

Figure 3:
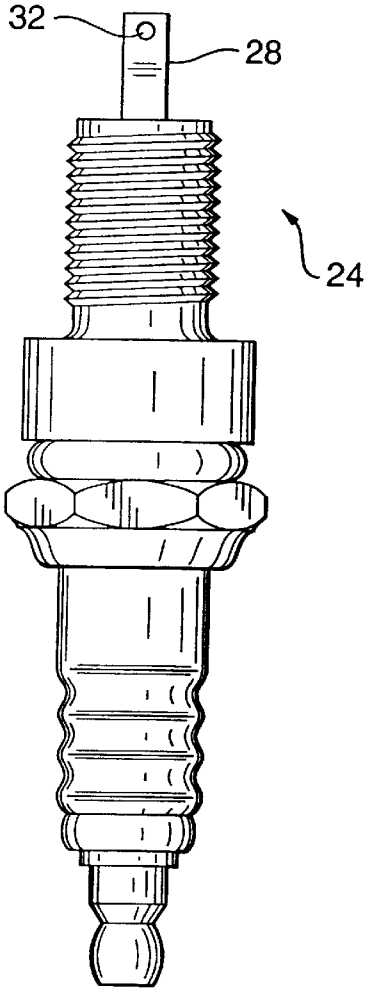
FIG. 3 is a front view of a spark plug being modified according to the invention.
Figure 5:
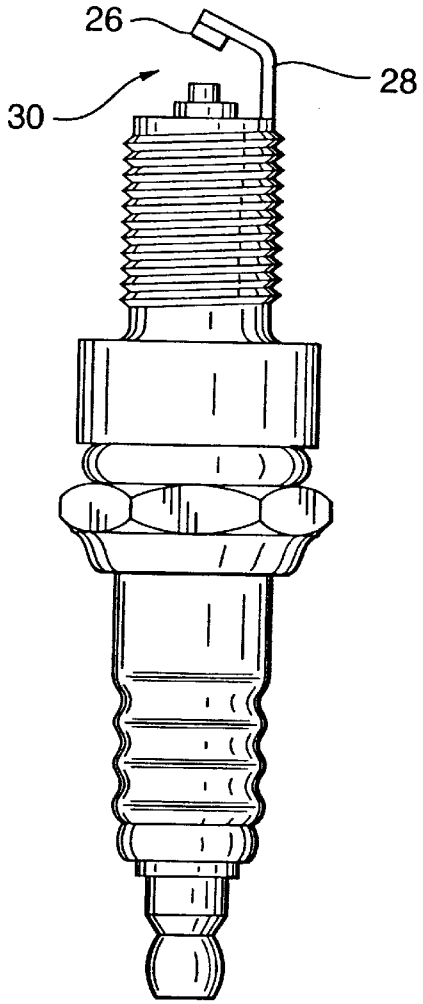
FIG. 5 is a back view of the modified spark plug showing the enlarged spark gap according to the invention; and, FIG. 6 is a cross-sectional view taken along the line 6—6 of FIG. 4.
Figure 4:
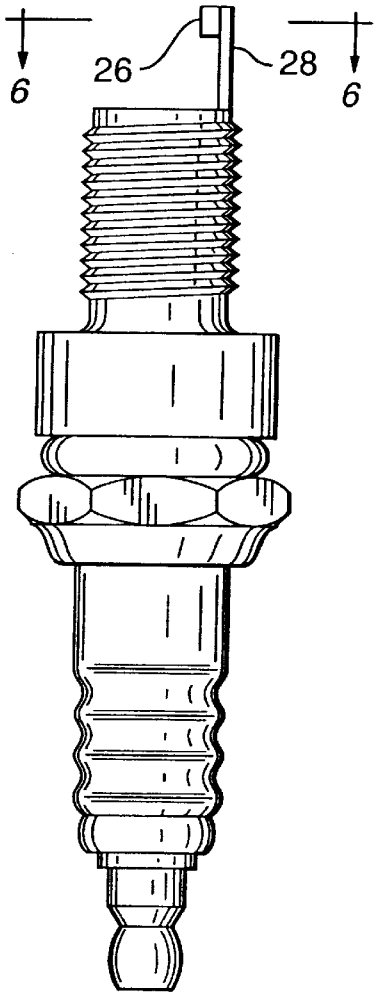
FIG. 4 is a side view thereof showing the sintered button cathode of the invention welded to the ground conductor thereof.

Referring to FIG. 3, in modifying a conventional spark plug 24, a hole 32 is drilled in the cathode lead 28. The button 26 is electrically spot welded to the cathode lead 28 (FIG. 4) and then the enlarged gap 30 is established (FIG. 5).

Figure 6:
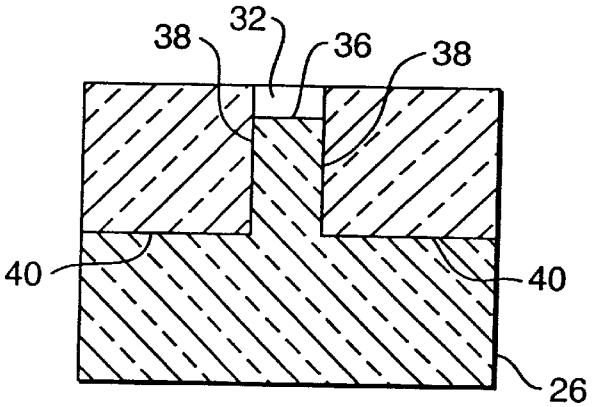

FIG. 6 shows how the button 26 is provided with a projecting key 36 fitting into hole 32. The weld occurs at the interface 38 and 40 between the button 26, the key 36, and the cathode lead 28.

DEFINITIONS

The following terms used herein are defined as follows:

RARE EARTH METAL: Elements having atomic numbers 21, 39 and 57 through 71 whether in elemental, compound, or alloy form.

OXIDES: Any compound consisting essentially of a metal and oxygen.

STAINLESS STEEL: An alloy of iron and chromium.

HIGH TEMPERATURE STAINLESS STEEL, An alloy of iron chromium and nickel preferable comprising at least about 11% chromium and at least about 3.5% nickel by weight.

AUSTENITIC STAINLESS STEEL: Stainless steels comprising 8 to 30% chromium and 6 to 20% nickel.

MAKING THE BUTTON

A convenient high temperature stainless steel to use is TYPE 304 which, by weight, consists essentially of 18 to 20% chromium, 8 to 12% nickel, up to 0.08% carbon, up to 2% manganese, up to 0.045% phosphorus, up to 0.03% sulfur, up to 1% silicon, and the rest iron.

This may be obtained in powder form from Atlantic Equipment Engineers of Bergenfield, N.J. as their number SS-101-304-325 MESH Stainless Steel CAS-65997-19-5. The largest particles in this powder are approximately 45 microns in diameter. The range of particle sizes is believed to be 35 to 45 microns.

An inexpensive and convenient cerium oxide powder in the form of cerium acetate hydrate $Ce(C_2H_3O_2)_3\ 1.5H_2O$ is available from UNOCAL 76 MOLYCORP of York, Pa. as catalog number 15294. We believe the diameters of the particles to be from 0.5 to 5.0 microns.

The powders are mixed and the cerium acetate reduced to cerium dioxide $CeO_2$ as follows:

Preclean the stainless steel powder (which contains a lubricant) using one teaspoon of liquid JOY® detergent in 500 ml. deionized water. Heat to 50° C. for 10 minutes. Decant and rinse the powder with deionized water to the pH of the incoming source water. Allow the powder to settle before pouring off the liquid. Rinse with absolute methanol a minimum of three times. Vacuum bake at 125° C. for one hour to allow the water and detergent to evaporate. Allow the oven to cool to room temperature before opening the vacuum door.

Place 25 grams of above powder in a 250 ml. clean beaker, add 0.32 grams of cerium acetate powder to the beaker and 100 ml. of absolute methanol. A lace a suitable watch glass on the beaker. Using a TEFLON® coated magnetic stir bar—hotplate apparatus (powder may be attracted to the stir bar), stir and heat at 65° C. or below. Use a glass stirring rod if necessary. Allow the methanol to evaporate down to near dryness. Remove from the hotplate, allow to cool.

Vacuum bake for one hour at 225° C. Allow the oven to cool to room temperature before opening the door. Dry grind the mixture with a mortar and pestle.

Transfer mixture to a 250 ml. clean beaker. Place the beaker on its side and heat in a muffle furnace at 400° C. for 5 minutes while turning the beaker approximately five times to exposed fresh powder surfaces. This dissociates the acetate and converts it to cerium dioxide. Place the beaker in a desiccator to cool to room temperature. Regrind mixture in a mortar and pestle. Seal powder in an appropriate container.

This process is for 25.125 grams final resultant weight lots, less losses due to magnetic retention on the stir bar apparatus. The final consolidation of the mixture assumes a normal particle size distribution of stainless steel powder to achieve the highest material density.

The above process can be readily adapted to other low work function metals and high temperature stainless steels.

The prepared powder is then placed in multicavity molds and sintered into the buttons shown in the drawings. The sintering is done at 645° C. at a pressure of 40 TONS per square inch and in an atmosphere of 90% hydrogen and 10% nitrogen. Steric acid is used as the mold releasing agent.

We believe that any high temperature stainless steel of TYPE 201 or higher will work in our invention and that the higher number types, being more oxidation, acid, and alkali resistant are most desirable from the standpoint of durability. While other low work function (under 3.0 eV) metal oxides could be employed in our invention; the rare earth metal oxides are preferred because of their very high melting points (over 2100° C.). Initiators according to our invention operate well under these temperatures. The rare earth oxides according to our invention do not dissociate and leak out of our electrodes which would occur if the pure metals that melt at much lower temperatures e.g. 798° C. for cerium were used.

In the above process, the first heating to about 50° does not decompose the detergent and helps dissolve contaminates. The second to about 125° C. drives off water and esters. The third to about 65° C. evaporates, but does not boil the methanol. The fourth to about 225° C. drives off surfactants. And the fifth to 400° C. is above the 308° C. dissociation temperature of cerium acetate and below the 798° C. melting point of cerium and forms the cerium dioxide.

The maximum sintering temperature is limited to below 798° C. the melting point of cerium.

An alternative method of forming the buttons from the stainless steel and low work function oxide (e.g. cerium dioxide) is to heat the mixture to above the 1425° C. melting point of the stainless steel, but not above the melting point of the oxide (3443° C. for cerium oxide) and then pour the mixture into molds or otherwise process it into electrodes. However, we believe that the sintering route makes a better product for a given amount of dopant as more is available at or near the surface to reduce the work function of the electrode if it is not alloyed into the stainless steel.

The buttons are then electrically spot welded to the cathode lead of the initiators according to our invention and as shown in the drawings.

Ignitors according to our invention provide faster rise times than the prior art and fire more uniformly when tested in air. Engines run smoother and are more quickly responsive to increases in throttle settings. An EPA protocol test of ourh inventing (Retrofit) using FTP-75 spark plugs in a MAZDA® Protege® produced the following results:

| Baseline | FTP-75 | Retrofit FTP-75 | Improvements |
|---|---|---|---|
| HC | 0.164 | 0.116 | 19% Reduction |
| CO | 2.106 | 1.515 | 18% Reduction |
| NOX | 0.042 | 0.070 | |
| CITY MPG | 29.308 | 30.881 | 5% Increase |
| HWY MPG | 40.345 | 40.245 | |

We believe even better results will be seen if the computer program of the car were adjusted optimally for the new plugs. Obviously, the "hotter" lengthened spark would permit a leaner (less $O_2$) mixture.

The cerium oxide doped buttons made as described above contain 0.43% cerium in the form of 0.54% cerium oxide by weight. The original powder mixture contained 1.27% cerium acetate by weight. We believe that the cerium content could be as little as 0.33% cerium. More than 0.43% cerium could be used to further lower the effective work function of the button. If the cerium oxide were alloyed in the stainless steel more would have to be used to get the same effective percentage of cerium at the surface of the electrode.

It will thus be seen that the objects set forth above, among those made apparent from the preceding description, are efficiently attained and since certain changes may be made in the above articles, methods, and compositions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Particularly it is to be understood that in said claims, ingredients or compounds recited in the singular are intended to include compatible mixtures of such ingredients or compounds wherever the sense permits.

Having described our invention, what we claim as new and desire to secure by Letters Patent is:

1. A cathode in an electrical combustion initiator for internal combustion engines comprising at its primary electron emitting surface sintered stainless steel powder comprising about 0.33% or more of a rare earth metal by weight.

2. An initiator as defined in claim 1 wherein said surface is formed on a button of said doped stainless steel that is welded to an electrical and heat conductive support.

3. An electrical combustion initiator for internal combustion engines comprising a cathode having as its primary electron emitting surface sintered powdered stainless steel doped with a low work function material.

4. An initiator as defined in claim 3 wherein said stainless steel comprises at least about 11% of chromium by weight.

5. An initiator as defined in claim 4 wherein said stainless steel comprises at least about 3.5% nickel by weight.

6. An initiator as defined in claim 3 wherein said stainless steel comprises at least about 3.5% nickel by weight.

7. An initiator as defined in claim 3 wherein said rare earth metal is the form of oxide particles substantially uniformly distributed in said stainless steel electrode.

8. An initiator as defined in claim 3 wherein said rare earth metal takes the form of particles substantially uniformly distributed throughout said powdered metal.

9. An initiator as defined in claim 8 wherein said particles of rare earth metal are about ⅕ or less the size of the particles of stainless steel.

10. An initiator as defined in claim 9 wherein said particles of rare earth metal are in the form of an oxide.

11. An initiator as defined in claim 10 wherein said stainless steel comprises by weight at least about 11% of chromium and at least about 3.5% of nickel.

12. An initiator as defined in claim 11 wherein said electrode takes the form of a button of said sintered powdered metal welded to an electrical and heat conductive support.

13. An initiator as defined in claim 11 wherein said oxide comprises about 0.54% or more of said sintered powdered metal.

14. An initiator as defined in claim 13 wherein said rare earth metal has a workfunction of about 3.0 eV, or less.

15. An initiator as defined in claim 3 wherein said rare earth metal has a workfunction of about 3.0 eV, or less.

16. An initiator as defined in claim 13 wherein said rare earth metal is cerium.

17. An initiator as defined in claim 3 wherein said rare earth metal is in the form of an oxide.

18. An initiator as defined in claim 17 wherein said rare earth metal is cerium.

19. An initiator as defined in claim 3 wherein said rare earth metal is cerium.

20. An initiator as defined in claim 3 wherein said surface is formed on a button of said doped stainless steel that is welded to an electrical and heat conductive support.

21. An electrical combustion initiator cathode for internal combustion engines having a primary electron emitting surface of which consists essentially of a sintered powdered stainless steel doped with from about 0.54% to less than 5% of an oxide of a low work function material.

22. An initiator as defined in claim 21 wherein said surface is formed on a button of said doped stainless steel that is welded to an electrical and heat conductive support.

* * * * *